United States Patent [19]

Vees et al.

[11] Patent Number: 4,774,120

[45] Date of Patent: Sep. 27, 1988

[54] METHOD FOR MULTIPLE-END-CLOSE-SET UNIFORM DENSITY PARALLEL WEFT INSERTION AND PRODUCTS THEREOF

[75] Inventors: Frederick Vees; Michael T. Fiedler, both of Minneapolis, Minn.

[73] Assignee: Xerkon, Inc., Minneapolis, Minn.

[21] Appl. No.: 23,690

[22] Filed: Mar. 9, 1987

[51] Int. Cl.[4] ..... B32B 3/06

[52] U.S. Cl. ..... 428/102; 112/232; 112/233; 112/234; 112/402; 112/440; 428/114; 428/294

[58] Field of Search ..... 112/440, 402, 232, 233, 112/234; 428/102, 114, 294

[56] References Cited

U.S. PATENT DOCUMENTS 4,325,999 11/1979 Champman ..... 428/112

4,444,025 5/1982 Krueger ..... 66/84

*Primary Examiner*—Marion C. McCamish

*Attorney, Agent, or Firm*—Oblon, Fisher, Spivak, McClelland & Maier

[57] ABSTRACT

A multiple-end weft-insertion process which is capable of achieving extremely high yarn density which is uniform in plys of structural fabrics is disclosed, making use of conventional machinery and systems. Yarn is transferred from a shuttle to yarn transfer elements spaced a sufficient distance apart to avoid damage to the yarn, and then transferred to yarn holding elements. Each successive pass of the shuttle is adjusted by moving the yarn transfer element parallel to the holding elements, so as to overlap each band deposited by the shuttle. The amount of movement necessary to achieve any desired density is calculated according to established parameters.

12 Claims, 4 Drawing Sheets

METHOD FOR MULTIPLE-END-CLOSE-SET UNIFORM DENSITY PARALLEL WEFT INSERTION AND PRODUCTS THEREOF

BACKGROUND OF THE INVENTION

1. Field of the Invention

This invention pertains to the art of manufacturing plys of structural fabric characterized by the presence of parallel, obliquely biased yarns of high modulus stitched together into a uniform ply, the ply having a high uniform density. More specifically, the invention provides a method for making plys of structural fabric of high yarn density, the yarns being parallel, biased and stitched together in a ply of uniform density through a weft-insertion process.

2. Description of the Prior Art

The increasing demand for composite materials comprised of fabrics produced from structural yarns of high modulus and impregnated with a cured resin, wherever high strength and stiffness and low weight is required, such as the aerospace industry, has placed a premium on process technology capable of providing a large volume of such structural fabrics at a reasonable cost, and of meeting exceedingly high specifications, such as those observed in the aerospace industry. One common type of structural fabric is a non-woven, stitched or knitted fabric, that is comprised of a plurality of plys of structural yarns. Because of the dynamics of stress and strain, and the loads applied to the structural fabrics, it is desirable, in many applications, to have the yarns present, in each individual ply, in a precise parallel array. Additionally, control over the density of yarns in the fabric, and control over the uniformity of density in the fabric, is critical. Frequently, it is desired to have a majority of the plys laid in at a bias to the fabric.

One of the most productive and cost-efficient methods of providing plys of structural yarns is the weft-insertion process, where a plurality of yarns is directed back and forth across a space defined by two advancing rows of hooks or retaining elements, the yarns being retained at each crossing by those retaining elements. As the yarns are retained by these elements, the hooks are advanced into a stitching machine, where stitching yarns are applied across the structural yarns. A single ply of fabric, with yarns oriented in a direction of 90° to the direction of the fabric, the yarns being relatively widely spaced is produced. The yarns are widely spaced due to the need to pass the yarns and carrier elements between the hooks, or otherwise retain them. Additionally, it is necessary to maintain this spacing to ensure the knitting needle can pass between adjacent yarns without engaging additional yarns or portions of yarns thereby producing a flaw in the fabric. Density of the fabric is commonly increased by making the infeed of laid-in yarns to the stitching machine higher than the output of stitched fabric. The yarns thus tend to "pile-up" in the machine, increasing density. Methods employing a differential between infeed and output are not applicable to biased or multi-ply fabrics or any other situation where infeed and output must be equal.

The chief drawback to such systems is that the best approximation of parallelity that can be made when a biased fabric, a multiple ply fabric or any other fabric produced where density on infeed is equal to density of output is what is termed a "cross-over" weft, where the structural yarns may vary from actual parallelity through a broad range. This cross-over is an inherent feature of such processes, as the shuttle which directs or carries the yarns reaches the end of its traverse, and returns, cross-over the yarns at that point. Such systems are featured in U.S. Pat. No. 3,756,893 which is particularly directed to providing a process for incorporating a multiple of layers in a single stitching operation, the yarn being oriented at any given direction.

Attempts have been made to overcome this inherent drawback in weft-insertion apparatus.

Thus, U.S. Pat. No. 4,325,999, in FIG. 11, columns 13 and 14, illustrates a method by which a 2-layer non-structural fabric can be produced, wherein each of the yarns in each layer is parallel, the yarns in respective layers being aligned at 90° to each other and 45° with respect to the long axis of the fabric. It should be noted that the apparatus requires the yarns to actually pass through spaces between the pins or retaining elements on the conveyor, and then turn around and pass back across those elements. The resulting fabric is therefore necessarily of low density, and not suitable for the above-described applications. A different approach is described in Canadian Patent No. 912,296, wherein the shuttle, which carries the yarn back and forth, carries the yarn through the retaining elements on the conveyors, and then moves at right angles to its basic traverse, or "racks", backwardly to positively engage the yarn around the retaining elements. While the Canadian Patent does not describe this feature, if racking motion of the shuttle is correctly controlled, this can result in the deposition of yarns that are parallel along their length. Such a result is described in British Patent No. 1,299,638. However, to achieve this goal, this apparatus also requires that the yarns travel between the retaining elements on each traverse.

While the requirement that the yarn travel between the retaining elements poses no problems for the production of fabrics which are not particularly dense, such as the designer fabrics of the Canadian Patent, an insurmountable obstacle is presented when making the high density structural fabric required for many technical applications such as the aerospace industry. When the yarn density in biased or multilayer fabrics is such that the yarn spacing must be less than about 0.3 inches and therefor the retaining rack, pin or element spacing must also be less than this value, problems occur.

A rather severe problem, particularly encountered with mechanisms racking the shuttle which is necessary to achieve parallelity, is the tendency of the yarns to fall between retaining elements other than those intended. As the yarn is not truly engaged until the shuttle is well on its way to the other end of its traverse, the yarn may slip into any of a number of spaces, causing many faults in the fabric. Additionally, overall, density is not likely to be uniform.

As a solution to this problem, a variety of yarn transfer mechanisms, or "rakes" have been developed, which receive the yarns from the yarn carriers, and then transfer them to the retaining elements when positive engagement is assured. Exemplary among them is U.S. Pat. No. 3,756,043. However, these rakes do not address the problem of achieving high density with parallelity.

In particular, these rake embodiments cannot be used to achieve high density because the spacing of transfer elements on the rake is required to be the same as the yarn density on the shuttle. At high densities, necessarily some yarns will be impaled by the transfer elements, rather than properly engaged. Upon movement of the rake, breakage of the yarns and resulting faults are likely to occur.

As a result, the only available, reliable method for providing high, uniform density structural fabric plies wherein the fibers are arranged in parallel is a single-end weft-insertion, where only a single yarn end is passed between the conveyors by the shuttle, or a machine where infeed and output density are not equal. The former process is capable of extreme reliability, but it is extraordinarily slow. The latter is limited to non-biased fabrics, those laid in at an angle of 90° with respect to the fabric. As a result, neither is a commercially acceptable method for producing the desired fabrics.

A further problem presented by commercial demands is the need to provide a wide variety of fabrics having different, but uniform, densities through a single fabrication technology. Even within a single application, e.g. aerospace, there is a need to be able to provide fabrics of a wide range of densities but common appearance and manufacturing.

Accordingly, there continues to be a pressing need for the provision of a proces whereby high density structural fabrics, suitable for impregnation with a resin in a fiber form, can be made at a reasonable cost such that the biased yarns of the fabric are all in parallel array, and otherwise resemble the products of weft-insertion.

SUMMARY OF THE INVENTION

One object of this invention is to provide a process whereby structural fabric plys of high modulus yarns in parallel array, and high and uniform density, without deviation from that parallelity, can be provided.

It is another object of this invention to provide a process for making the described structural fabrics which is adaptable to existing machinery and manufacturing processes, at minimal cost.

It is a further object to provide a single process capable of producing a wide variety of uniform fabric densities.

These and other objects that are made clear below are achieved by a process which involves a conventional weft-insertion shuttle and conveyor arrangement, such that a shuttle, provided with a reed, traverses rapidly back and forth over a space defined by two in-feed conveyors which advance toward a stitching machine. The shuttle carries a plurality of yarns. At the end of each traverse, the shuttle passes over the conveyor, and the yarns carried by the shuttle are transferred to yarn transfer elements, which are positioned outside the conveyor, and lie parallel to the conveyor. These yarn transfer elements then immediately move or "rack", parallel to the conveyors, in the direction opposite to the advance of the conveyors. This racking is achieved before the shuttle has passed back over the conveyor adjacent the engaged yarn transfer elements on its return trip.

Thereafter the yarn transfer elements move sychronously with the conveyor to their original position. As the shuttle moves back away from the first conveyor, the yarn transfer elements release the yarns, which are then engaged by the needles, hooks, or similar yarn holding or retention devices provided on the conveyors. The yarn transfer elements, which may be units of a plurality of needles or races similar to, or identical, with those provided on the conveyor, are spaced no closer together than 0.3 inches or whatever minimum tolerance is necessary to ensure positive placement and engagement of the yarn with smooth operation. The shuttle then travels over to the other conveyor, where another yarn transfer element is positioned, and the same operation takes place.

As the shuttle rapidly moves back and forth between conveyors and yarn transfer elements, each band of yarns laid down by the shuttle is overlaid, to some degree, with the preceding band or bands, by virtue of the racking motion of the yarn transfer elements. This racking motion, together with the speed of advance of the conveyors, can be predetermined, given the number of yarns to be carried on the shuttle, and the yarn spacing on the shuttle, to give any desired yarn density. Thus, in contrast to prior art systems, which rack a distance equal to the width of the yarn band, the racking motion herein is designed to ensure uniform density over a wide range of densities.

Yarn holding elements, such as pins or hooks, may be spaced on the conveyors as desired. Current operating methods make use of conveyors with 12 or 14 elements per inch. Of course, as a result of this process, more than one yarn lies between given pairs of adjacent holding elements and/or yarns are impaled on the elements. While, on a microscopic scale, this causes some "bundling", the packing pattern of the yarns eliminates any perceptible deviations. This can be further controlled by increasing the number of elements per inch. The maximum number of elements per inch is limited by the space necessary to firmly seat the yarn between two needles, or impale the yarns.

Thus, a method is provided whereby biased or multiply fabrics of a uniform density much greater than one yarn per every half or one-third inch can be provided, yet the yarns are maintained in parallel array, and there is no danger of breaking the yarns due to impalement on the rake or scraping yarns over holding elements or misplacement of the yarns due to the return of the racking shuttle.

DETAILED DESCRIPTION OF THE INVENTION

Figure 1:
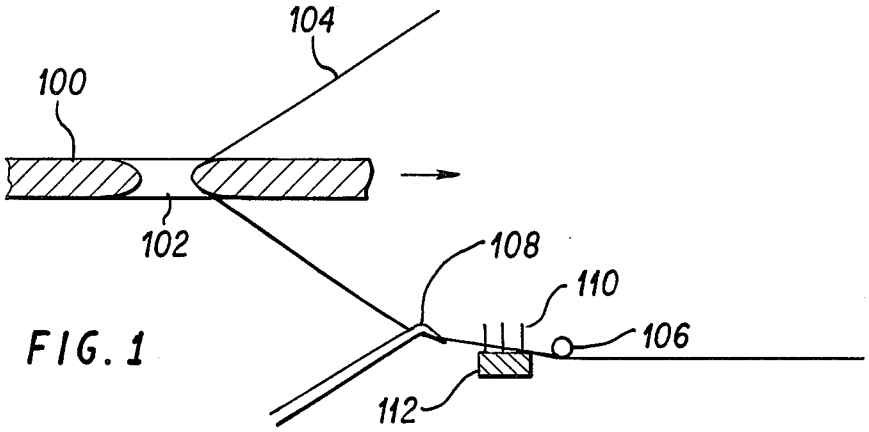
FIGS. 1–3 and 4–7 illustrate alternative methods of engagement and release of the yarn by the yarn transfer elements.

As noted above, this invention can be practiced using machinery that is entirely conventional, or that can be adapted without major modification. The basic elements of a weft insertion apparatus are all applicable to the invention. Thus, two "endless" conveyors provided with hooks or other yarn retention elements are mounted and provided with a synchronous drive, which advances the hooks into a stitching machine, where the yarns are stitched together, and removed from the hooks. The looped portion of the yarns, that which is looped around the retention elements, is frequently trimmed away at this stage. This apparatus is also provided with at least one weft-insertion shuttle or carriage, which traverses across the conveyors, and is provided with the ability to depress the yarns carried by the shuttle at either end of its traverse, so as to bring them within reach of engagement with the yarn transfer elements to be used. Although the invention is by no means limited to any one particular type of lay-down apparatus and weft carriage, a particularly preferred mechanism is disclosed in U.S. Pat. No. 4,444,025, the disclosure of which is incorporated herein by reference. That particular carrier mechanism is characterized by the provision of a slanted cam, which allows the rotation of the bars of the shuttle depressing the yarns for engagement to be relatively gentle, and at the same time reducing weight, and improving performance, of the shuttle. Other carriages, providing equivalent function, such as that of U.S. Pat. No. 4,556,440, are also known. To take particular advantage of this system, to allow it to produce biased as well as 0°/90° fabrics, the weft carrier should be capable of crossing the conveyors at positive angle, thus introducing bias. This concept is disclosed, e.g., in U.S. Pat. No. 4,489,459.

The yarn transfer elements of the machinery necessary to practice the inventive process are also not unknown, per se, although it is believed that they have never previously been applied to the manufacture of structural, high uniform density fabrics. In U.S. Pat. No. 4,395,888, a device referred to as a thread guide, or a carriage provided with a plurality of thread guides, is described, which receives the thread carried by the shuttle or carrier, and retains it, prior to releasing it for engagement with the holding elements of the endless conveyor belt. Such thread guides can be modified to be suitable for use with structural yarns and fabrics. Other yarn transfer elements are known.

In a preferred embodiment, the yarn transfer elements comprise a support upon which are mounted a plurality of hooks, pins or other devices to temporarily engage the yarn. These devices are provided with a slanted edge on the end a "hook" at the free of the engagement device. As the hook is engaged by the yarn carried by the shuttle, the "racking" motion of the transfer element is effected. As the shuttle moves off away from the yarn retention element, the yarn slides off the needle hook and onto the yarn holding elements of the conveyor due to the decreasing angle between the shuttle and the engagement device. The transfer element then returns to its original position.

The hooks, etc. to be employed are conventionally employed on the conveyors of currently available weft-insertion apparatus, and are commercially available.

Once transported to the needle bar of the stitching machine, the parallel yarns are stitched together through conventional technology, and exit the stitching machine as a uniform structural ply, suitable for incorporation in structural articles for resin impregnation.

The operation of the process of this invention is further described with reference to the Figures, wherein like reference characters indicate like features in all drawings.

As illustrated in FIG. 1, shuttle 100 with a reed opening 102 provided therein, through which structural yarn 104 passes, has reached the end of its traverse on the left hand side. At this point, the yarn 104 is depressed by presser bar 106, which may be mounted on shuttle 100. In this position, the yarn is engaged by yarn transfer element needle 108. In the figures, only one yarn transfer needle, one conveyor yarn holding element and one yarn are illustrated. Of course, in actual operation, a plurality of each would be present, in parallel. As shown in FIG. 1, yarn retention elements 110 on conveyor 112 have not yet engaged structural yarn 104.

Figure 2:
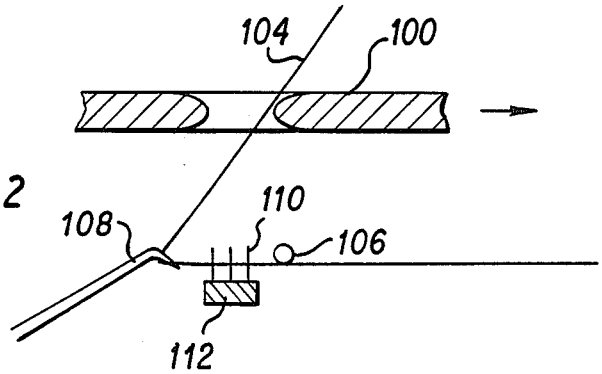

In FIG. 2, yarn transfer needle 108 has engaged the yarn by "racking" in a direction parallel to yarn retention elements 110 and in a direction opposite to their advance. The shuttle has not passed back over yarn holding elements 110 before this racking is completed.

Figure 3:
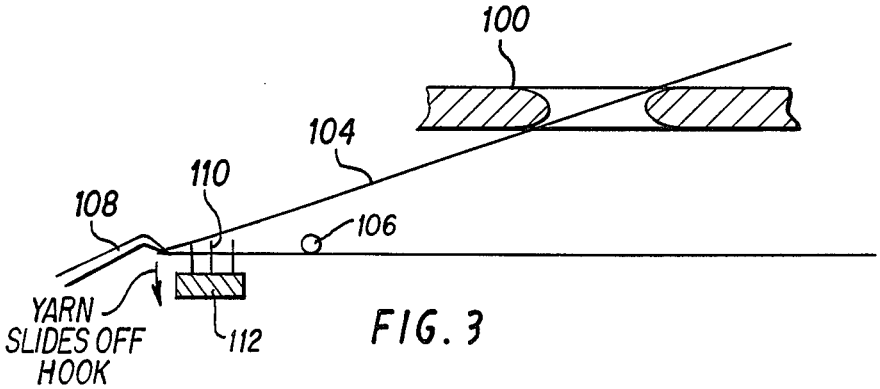

As shown in FIG. 3, as the shuttle moves farther away from yarn holding elements 110, the angle between shuttle 100 and yarn transfer needle 108 decreases to a point where the yarn slides off needle 108, and is held by yarn retention elements 110. It should be noted that each yarn retention element may be comprised of a plurality of pins, as illustrated, in order to ensure uniform holding of the yarn by the retention elements. An identical operation occurs when shuttle 100 reaches the end of its traverse on the opposite side.

Figure 4:
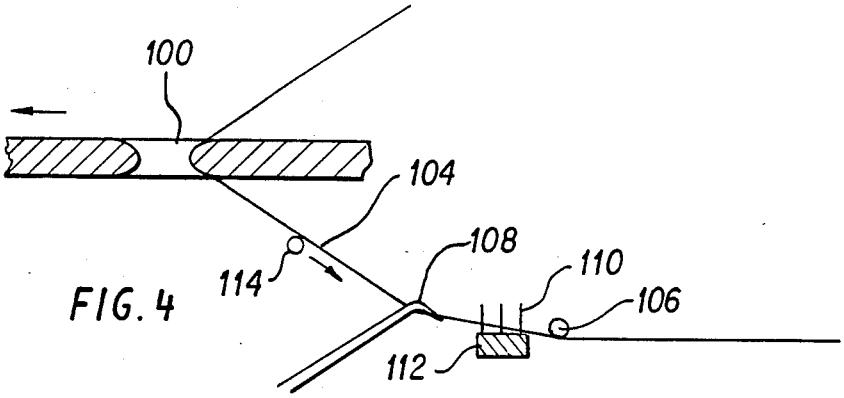
Figure 5:
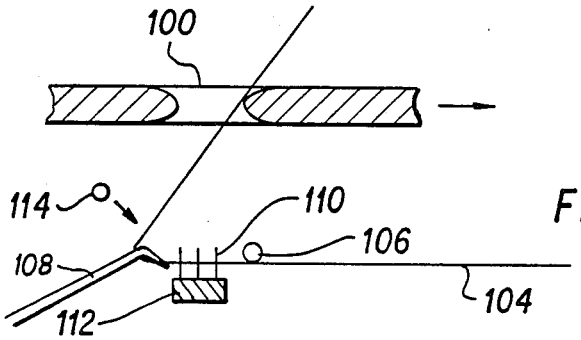

An alternative embodiment of operation is illustrated in FIGS. 4–7. In FIG. 4, the shuttle is illustrated in the same position as in FIG. 1, discussed above. In this embodiment, an additional strip-off bar 114 is featured, carried on the carriage (not illustrated) supporting yarn transfer element 108.

Figure 6:
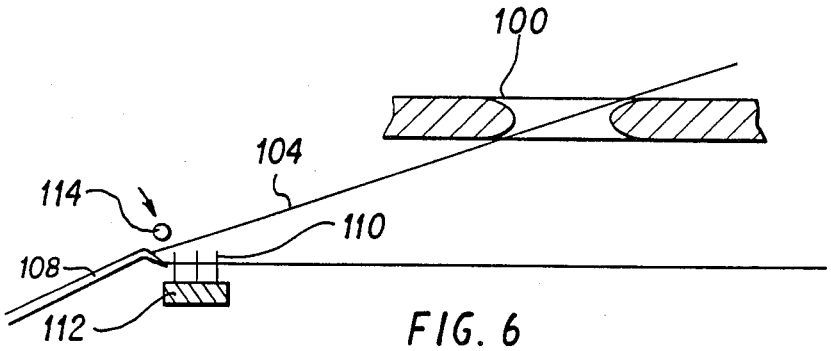
Figure 7:
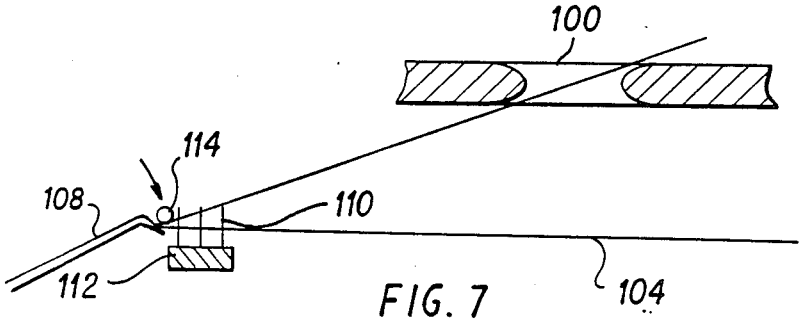

The initial operation of the system in this embodiment is the same as discussed above, that is the presser bar 106 depresses yarn 104 as shuttle 100 reaches the end of its traverse, whereby the yarn is engaged by yarn transfer element 108. As the shuttle returns, the yarn transfer element is racked parallel to the conveyor 112, the yarn transfer element thereby engaging yarn 104. At about the point where the yarn 104 would be released from yarn transfer element 108 by action of the shuttle 100 alone, strip-off bar 114 descends, synchronously with the movement of the shuttle. Just prior to release of the yarn, this embodiment appears as illustrated in FIG. 6.

When the strip-off bar contacts yarn 104, the presence of the strip-off bar makes engagement with the retention elements 110 of conveyor 112 far more positive and assured. Thus, where the selection of various structural yarns and operating conditions raises the possibility that the yarns will not be adequately and firmly engaged by the holding elements upon their release from the transfer elements, this embodiment should be used.

Figure 8:
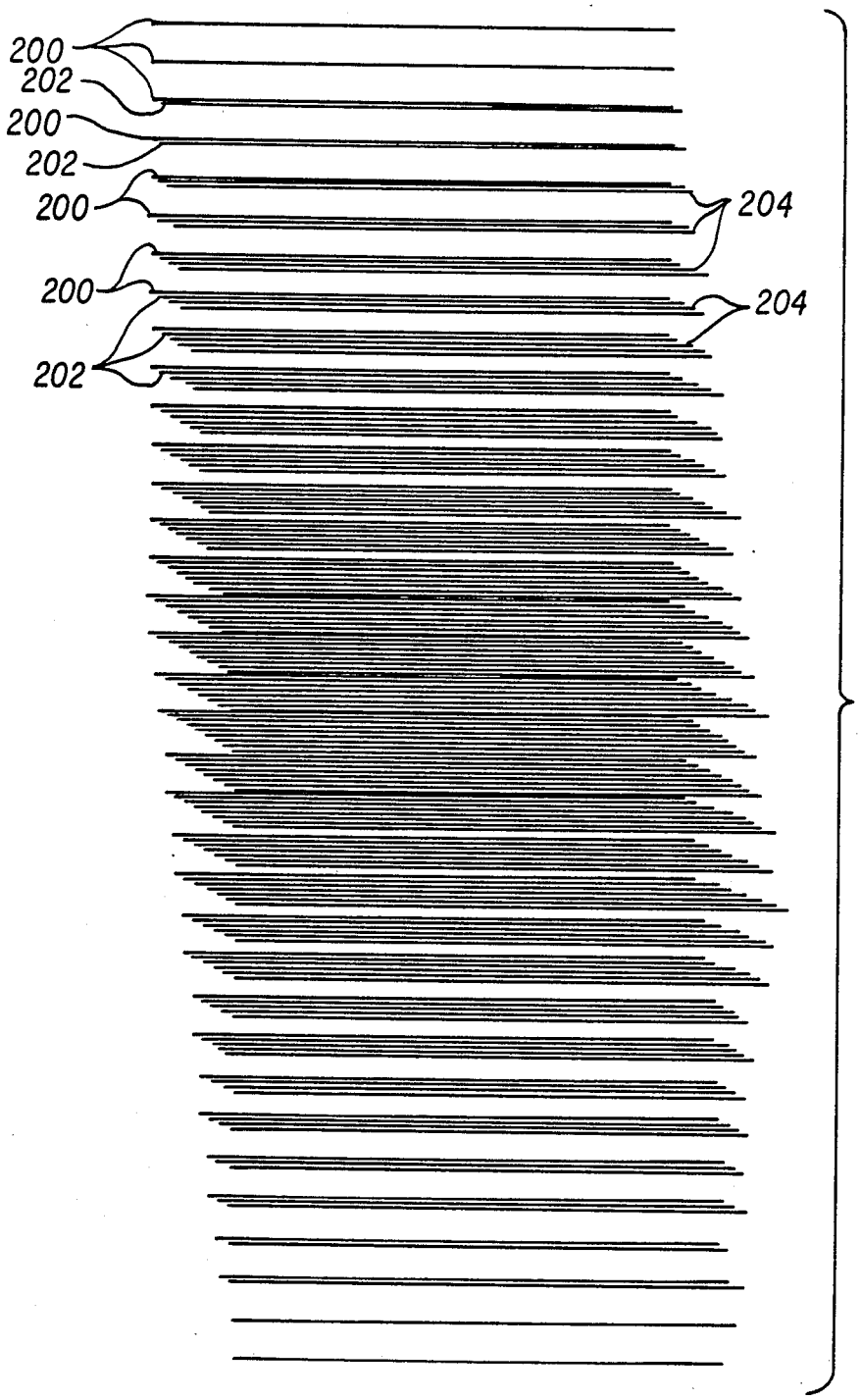
FIG. 8 illustrates one type of fabric that may be produced by this invention, and the overlay pattern employed.

As noted above, the racking action of the yarn transfer element can be employed to insure that each band laid down by the shuttle overlaps with bands previously laid down, such that an extremely high and uniform density of yarns in the fabric can be obtained. The results of such a lay down is illustrated in FIG. 8. As is shown therein, at the beginning and end of each run, the fabric has a low density, and does not meet the specification set for such a fabric, which in this example is a density of 16 lines or yarns per inch. However, in the center of the fabric, this density is easily achieved. It should be noted that the fact that the beginning and ends of each run do not meet the required density specifications does not necessarily introduce additional waste or extra cost, as these portions of any run in conventional processes are usually trimmed and discarded.

To clearly illustrate the manner in which the invention operates, in FIG. 8, every successive lay down has been slightly shifted. In the center of the fabric depicted, any variations in density are due to the resolution of the depiction device, and do not reflect actual deformities in the ply formed. Thus, in the first pass, the shuttle lays down, in this example, 17 yarn ends. These are designated 200. On its return pass, due to the racking action of the yarn transfer element, a parallel, but slightly shifted band of 17 lines is laid down, designated 202. On the return trip, a third set, 204, is subsequently laid down. It is apparent that as the racking operation is repeated, overlap is increased, until the desired density is achieved.

In the embodiment pictured in FIG. 8 and described above, the controlling parameters were the desired density, 16 ends per inch, the number of yarns the shuttle can carry, and critically, yarn spacing on the shuttle and hook spacing on the transfer element, which was 0.5 inches. In this situation, to achieve the fabric illustrated in FIG. 8, the racking distance, or band displacement, is 1.0625 inches. (The fabric has been illustrated without the secondary stitching yarns, for ease of illustration. Once passing through the stitching machine, however, this fabric would be held together by secondary yarns stitched through the fabric.)

Figure 9:
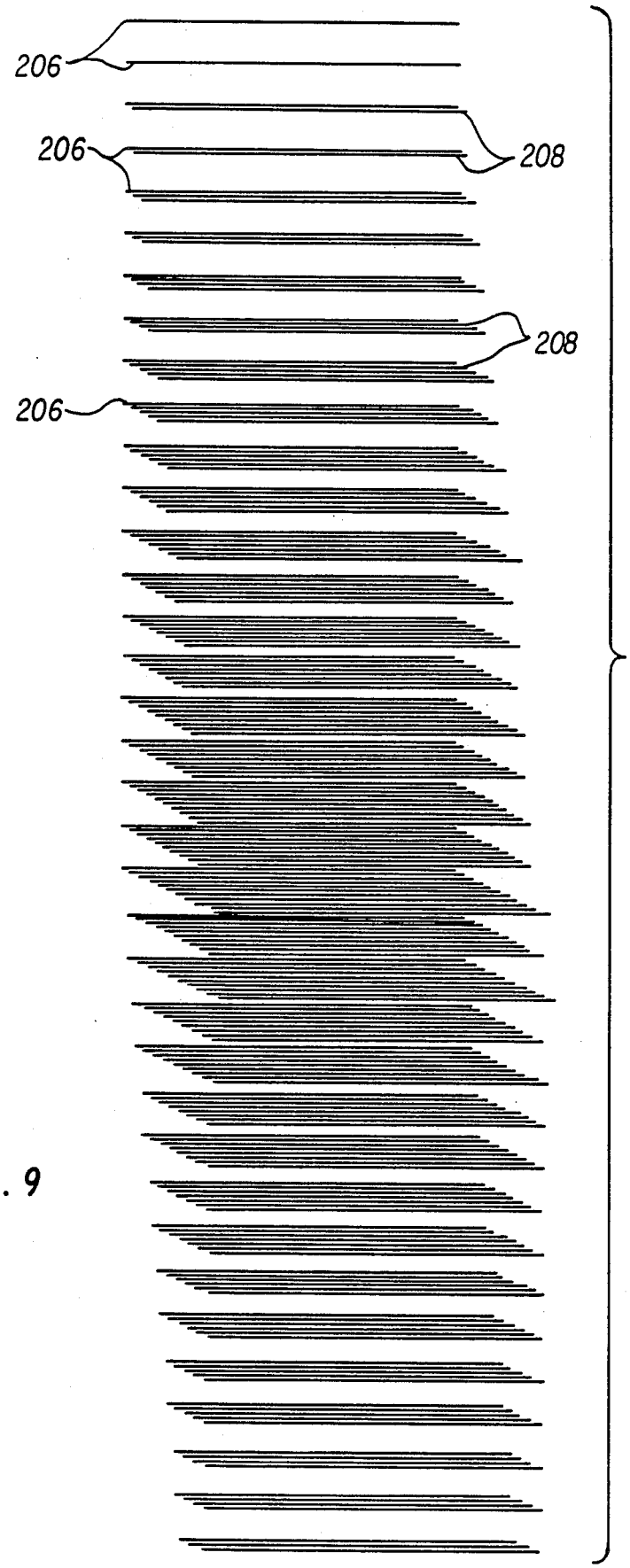
FIG. 9 illustrates an alternative fabric and overlay pattern

FIG. 9 is a similar diagram, where the parameters controlling the amount of racking have been changed. Thus, while the desired density is still 16 yarns per inch, in this embodiment, the shuttle carries 21 yarns ends. These are first laid down as yarn ends 206, which are followed by the deposition of bands 208, on the return trip of the shuttle.

Appropriate displacements can be achieved by calculation for given desired uniform densities. The general relationships are set forth below.

The relationship between the strands on the shuttle, the racking of the transfer element, the yarn spacing on the shuttle, and transfer elements and the yarn density are as follows:

| | |
|---|---|
| Yarn density in fabric as measured parallel to the conveyors: | d |
| Yarns on shuttle: | b |
| Racking of transfer element: | a |
| Yarn spacing on shuttle and transfer element hook spacing: | c |
| Width of shuttle that is strung with yarn: | e |
| Integer: | n |
| FORMULAE: | |
| Yarn Density in Fabric | $d = (1/c)\frac{(b-1)}{n}$ |
| Yarn Spacing on Shuttle | $c = (b-1) \times (1{:}d) \times (1{:}n)$ |
| Racking of Transfer Element | $a = b{:}d = nc + 1/d$ |
| Strung Width on Shuttle: | $e = c \times (b-1)$ |

Thus for a fixed value c at various strung widths from 0.5 to 15 inches, and corresponding number of yarns on the shuttle ranging from 2–31, densities ranging from 2 ends per inch up to 60 ends per inch may be obtained, by varying n. This astonishing range of densities can be displayed as a numerical list.

To achieve uniform density values between those set forth in the following list, c can be altered according to the formula for yarn density. Unlike b and n, which are integral values, c can be any value above about 0.3.

| Possible densities d arranged in ascending order | | | | | |
|---|---|---|---|---|---|
| 2.0000 | 2.4348 | 3.1667 | 4.5455 | 7.5000 | 23.0000 |
| 2.0690 | 2.444 | 3.1765 | 4.5714 | 7.6000 | 24.0000 |
| 2.0714 | 2.4545 | 3.2000 | 4.6000 | 7.6667 | 25.0000 |
| 2.0741 | 2.4615 | 3.2222 | 4.6154 | 7.7143 | 26.0000 |
| 2.0769 | 2.4706 | 3.2308 | 4.6667 | 8.0000 | 27.0000 |
| 2.0800 | 2.4762 | 3.2500 | 4.7273 | 8.2857 | 28.0000 |
| 2.0833 | 2.5000 | 3.2727 | 4.7500 | 8.3333 | 29.0000 |
| 2.0870 | 2.5217 | 3.2857 | 4.8000 | 8.4000 | 30.0000 |
| 2.0909 | 2.5263 | 3.2941 | 4.8333 | 8.5000 | 32.0000 |
| 2.0952 | 2.5455 | 3.3333 | 4.8571 | 8.5714 | 34.0000 |

-continued

| Possible densities d arranged in ascending order | | | | | |
|---|---|---|---|---|---|
| 2.1000 | 2.5556 | 3.3750 | 4.8889 | 8.6667 | 36.0000 |
| 2.1053 | 2.5714 | 3.3846 | 4.9091 | 8.8000 | 38.0000 |
| 2.1111 | 2.5882 | 3.4000 | 5.0000 | 9.0000 | 40.0000 |
| 2.1176 | 2.6000 | 3.4118 | 5.0909 | 9.2000 | 42.0000 |
| 2.1250 | 2.6087 | 3.4286 | 5.1111 | 9.3333 | 44.0000 |
| 2.1429 | 2.6154 | 3.4545 | 5.1429 | 9.5000 | 46.0000 |
| 2.1429 | 2.6250 | 3.5000 | 5.2000 | 9.6000 | 48.0000 |
| 2.1481 | 2.6316 | 3.5294 | 5.2500 | 9.6667 | 50.0000 |
| 2.1538 | 2.6364 | 3.5385 | 5.2727 | 10.0000 | 52.0000 |
| 2.1538 | 2.6667 | 3.5556 | 5.3333 | 10.4000 | 54.0000 |
| 2.1600 | 2.7000 | 3.5714 | 5.4000 | 10.5000 | 56.0000 |
| 2.1667 | 2.7059 | 3.6000 | 5.4286 | 10.6667 | 58.0000 |
| 2.1739 | 2.7143 | 3.6250 | 5.4545 | 10.8000 | 60.0000 |
| 2.1818 | 2.7273 | 3.6364 | 5.5000 | 11.0000 | |
| 2.1905 | 2.7368 | 3.6667 | 5.5556 | 11.2000 | |
| 2.2000 | 2.7500 | 3.6923 | 5.6000 | 11.3333 | |
| 2.2000 | 2.7619 | 3.7143 | 5.6667 | 11.5000 | |
| 2.2105 | 2.7692 | 3.7500 | 5.7143 | 11.6000 | |
| 2.2222 | 2.7778 | 3.7778 | 5.7500 | 12.0000 | |
| 2.2308 | 2.8000 | 3.8000 | 5.7778 | 12.5000 | |
| 2.2353 | 2.8235 | 3.8182 | 5.8000 | 12.6667 | |
| 2.2400 | 2.8333 | 3.8333 | 6.0000 | 13.0000 | |
| 2.2500 | 2.8421 | 3.8462 | 6.2222 | 13.3333 | |
| 2.2609 | 2.8571 | 3.8571 | 6.2500 | 13.5000 | |
| 2.2727 | 2.8750 | 4.0000 | 6.2857 | 14.0000 | |
| 2.2857 | 2.8889 | 4.1429 | 6.3333 | 14.5000 | |
| 2.3000 | 2.9000 | 4.1538 | 6.4000 | 14.6667 | |
| 2.3077 | 2.9091 | 4.1667 | 6.4444 | 15.0000 | |
| 2.3158 | 2.9231 | 4.1818 | 6.5000 | 15.3333 | |
| 2.3200 | 2.9412 | 4.2000 | 6.5714 | 16.0000 | |
| 2.3333 | 2.9474 | 4.2222 | 6.6667 | 16.6667 | |
| 2.3478 | 3.0000 | 4.2500 | 6.7500 | 17.0000 | |
| 2.3529 | 3.0526 | 4.2857 | 6.8000 | 17.3333 | |
| 2.3636 | 3.0588 | 4.3077 | 6.8571 | 18.0000 | |
| 2.3750 | 3.0769 | 4.3333 | 7.0000 | 18.6667 | |
| 2.3810 | 3.0909 | 4.3636 | 7.1429 | 19.0000 | |
| 2.4000 | 3.1111 | 4.4000 | 7.2000 | 19.3333 | |
| 2.4167 | 3.1250 | 4.4444 | 7.2500 | 20.0000 | |
| 2.4211 | 3.1429 | 4.4615 | 7.3333 | 21.0000 | |
| 2.4286 | 3.1579 | 4.5000 | 7.4286 | 22.0000 | |

The claimed process, which allows the ordinary artisan to provide a ply of high uniform density, parallel biased structural yarns using a multiple-end system which is rapid and economical, does not require any substantial modifications of machinery or controlling apparatus. It is capable of providing various densities over a vast range. It should also be appreciated that, in addition to being suitable for use in conjunction with conventional systems which employ a single lay down carriage or shuttle, producing one ply at a time, this system is also adaptable to multiple-carriage systems, where several plys are incorporated into a single fabric in one processing operation. Such systems are disclosed in U.S. Pat. Nos. 4,484,459, and 4,550,045, the relevant disclosures of which are incorporated herein by reference. Additionally, it should be immediately obvious that the method of providing biased fabrics, as well as weft-insertion fabrics at 90° to the axis of the fabric, as disclosed in those patents, can be employed using the system of this invention.

This system is applicable to the weft-insertion of virtually any type of yarn or fiber. However, because the system is particularly adapted to overcoming the problems encountered where structural fibers of high modulus are employed with close element spacing, particularly preferred yarns are those exhibiting a modulus of about 8 million lbs./in.$^2$ or more, including certain types of fiberglass, graphite and other carbon fibers, certain polyamid and other thermosetting polymers, etc. The yarn fiber used as the secondary yarn to stitch the parallel structural yarns into a unitary fabric ply can be selected from virtually any natural or synthetic material. Among relatively low-modulus yarns, certain polyesters are extremely easy to work with, and accordingly, preferred. Certain embodiments, for extremely high strength applications, require the use of high modulus yarns as the secondary or stitching yarns as well. One particularly preferred embodiment is where both the parallel yarns and the stitching yarns are comprised of graphite or other carbon-derived materials.

Once the fabric has been stitched together, it may be incorporated, as is, in a multi-ply structural article, generally subsequently infused with a resin which can be cured, or first cut and shaped and then incorporated in the end product, through known technology such as hand lay-up operations, and automated equivalents. The individual plys produced may, depending on the stitching employed, also be suitable for the biasing process of U.S. Pat. No. 4,567,758 and incqrporated into a biased structural fabric thereby.

Accordingly, the long-felt need for a process which provides a way of producing high uniform density structural fabrics the yarns of which are in parallel array, by using conventional machinery and systems already available, is met hereby. The motion of the shuttle and racking action of the transfer mechanism, as well as the synchronization of all movements, can be achieved through well-established techniques, generally disclosed in the United States and foreign patents referenced above. No unusual modification or adjustments are made necessary by this invention.

Obviously, numerous modifications and variations of the present invention ar possible in light of the above teachings. It is therefore to be understood that within the scope of the appended claims, the invention may be practiced otherwise than as specifically described herein.

What is claimed as new and desired to be secured by Letters Patent of the United States is:

1. A process for forming a ply of structural fabric comprised of parallel structural yarns in a desired density, comprising:

directing a plurality of yarns defining a band having a given width back and forth over two parallel, spaced apart continuously advancing in-feed conveyors by means of a shuttle reciprocating between end positions beyond each conveyor, transferring said yarns to said conveyors at the end of each reciprocation by leading said yarns past yarn retention elements on the conveyor adjacent to said shuttle at its end positions and engaging said yarns on yarn transfer elements positioned on the side of said adjacent conveyor opposite the opposed conveyor, parallel and adjacent to said conveyor, and moving said transfer elements parallel to said conveyor a predetermined distance in the direction opposite to the advance of said conveyors, prior to completion of the movement of said shuttle back over the conveyor adjacent said element, thereafter completing reciprocation of said shuttle whereby the yarns are released from said yarn transfer elements and retained by said yarn holding elements carried on said conveyors, advancing said conveyors and the yarns held thereon into a stitching machine, wherein said yarns are stitched together into a structural fabric ply, the movement of said yarn transfer elements being calculated to provide a biased multi-ply parallel array of structural yarns in a high uniform density.

2. The process of claim 1, wherein the length a of said movement of said transfer elements is determined according to the relationship $a=nc+1/d$, wherein d is the desired fabric density, c is the yarn spacing on the shuttle, n is an integer no greater than $b-1$, wherein b is the number of yarns on the shuttle.

3. The process of claim 1, wherein said yarns are spaced on said shuttle, and said yarn transfer elements are spaced, no less than 0.3 inches apart.

4. The process of claim 1, wherein said density is greater than about 8 yarn ends per inch.

5. The process of claim 1, wherein said yarns are structural yarns having a modulus in excess of 8 million lbs./in.$^2$.

6. The process of claim 1, wherein said yarns are released from said transfer elements by the reciprocating action of said shuttle, whereby the angle between said shuttle and said yarn is progressively reduced, until the yarn is released by said yarn transfer element by virtue of a slanted edge provided thereon and retained by said yarn holding element.

7. The process of claim 1, wherein the transfer of said yarns from said transfer element to said holding element is assisted by depressing a strip-off bar into contact with said yarns retained on said yarn transfer elements at a point adjacent to said yarn holding elements.

8. A uniform fabric ply comprised of stitch-bonded, continuous, parallel, biased yarns produced by a weft insertion process comprising engaging said yarns on a plurality of paired yarn retention elements mounted on spaced apart conveying means, which means conveys said yarns into a stitch bonding means, wherein the density of yarns in said ply is uniform and greater than the density of said yarn retention elements on said conveying means.

9. The fabric of claim 8, wherein said yarns are structural yarns having a modulus in excess of about eight million lbs./$^2$.

10. The fabric ply of claim 9, wherein said ply is stitch-bonded to other plys of structural yarns in a multi-ply structural fabric.

11. A structural article prepreg, comprised of the structural fabric of claim 10, which is saturated with a curable resin.

12. A structural article, comprising the prepreg of claim 11 which has been cured.

* * * * *